US006748857B2

(12) United States Patent
Seiler et al.

(10) Patent No.: US 6,748,857 B2
(45) Date of Patent: Jun. 15, 2004

(54) CROP MARK SETTING DEVICE

(75) Inventors: Thomas Seiler, Thun (CH); Daniel Burri, Konolfingen (CH); Martin Fröhlich, Liebefeld (CH)

(73) Assignee: Maschinenfabrik Wifag, Bern (CH)

( * ) Notice: Subject to any disclaimer, the term of this patent is extended or adjusted under 35 U.S.C. 154(b) by 0 days.

(21) Appl. No.: 10/629,073

(22) Filed: Jul. 28, 2003

(65) Prior Publication Data

US 2004/0025725 A1 Feb. 12, 2004

(30) Foreign Application Priority Data

Aug. 9, 2002 (DE) ..... 102 36 657

(51) Int. Cl.[7] ..... B41F 13/56; B41F 5/04

(52) U.S. Cl. ..... 101/226; 101/224; 101/227; 101/228; 101/220; 101/263; 101/485

(58) Field of Search ..... 101/227, 228, 101/485, 224, 226, 220, 263; 226/40, 42, 111

(56) References Cited

U.S. PATENT DOCUMENTS 4,063,505 A * 12/1977 Sasamoto et al. ..... 101/228
5,289,770 A * 3/1994 Hern ..... 101/226
5,458,062 A * 10/1995 Goldberg et al. ..... 101/485
5,749,567 A * 5/1998 DeAngelis ..... 270/7
5,996,491 A * 12/1999 Kishine et al. ..... 101/223
6,082,259 A * 7/2000 Siegenthaler et al. ..... 101/227
6,106,177 A * 8/2000 Siegl et al. ..... 400/618
6,321,650 B1 * 11/2001 Ogawa et al. ..... 101/227
6,526,889 B2 * 3/2003 Tokiwa ..... 101/485

* cited by examiner

*Primary Examiner*—Andrew H. Hirshfeld
*Assistant Examiner*—Mark P. Crenshaw
(74) *Attorney, Agent, or Firm*—McGlew and Tuttle, P.C.

(57) ABSTRACT

A printing press with crop mark setting device and process is provided. A printing couple for printing on a web is used with a lengthwise cutting device for cutting the printed web lengthwise into a first web strand and at least one second web strand. A convergence device converges the web strands or for converging the web strands with at least one other web strand each to provide one or more converged web strands, the convergence device including a turning bar device. A cross-cutting device cross-cuts the converged web strands. A crop mark sets a crop mark of the web strands that is related to the cross cutting. The crop mark setting device has a first deflecting device for deflecting the first web strand around a first deflection axis and a second deflecting device for deflecting the second web strand around a second deflection axis. The second deflecting device is mounted movably in relation to the first deflecting device in a frame such that a length of a path of the second web strand in relation to the length of the path of the first web strand can be changed by a movement of the second deflecting device in relation to the first deflecting device. The crop mark setting device is arranged in front of the turning bar device with respect to a direction of delivery of the web.

21 Claims, 4 Drawing Sheets

CROP MARK SETTING DEVICE

FIELD OF THE INVENTION

The present invention pertains to crop mark setting devices in printing presses, in which a web conveyed endlessly is, or preferably a plurality of such webs are, printed on. Furthermore, the present invention pertains to a process for setting the crop mark of printed web strands, which were obtained from one or more webs by lengthwise cutting. The printing press is preferably a web-fed printing press, in which the web or the plurality of webs are unwound continuously from a roll each. The present invention is used especially preferably in the web-fed rotary printing of large numbers of newspaper copies.

BACKGROUND OF THE INVENTION

At least two prints arranged next to each other are printed continuously on the web or usually on a plurality of webs in the running print production. When viewed in the direction of delivery, the same print or a periodic sequence of two or, in principle, even more different prints may be printed on the web one after another. The web is, or the plurality of webs are, cut lengthwise into web strands between the prints arranged next to each other. A plurality of web strands are converged into a bundle corresponding to the running print production and cut together at right angles to the direction of delivery of the particular bundle in order to obtain the individual printed products, e.g., newspapers or magazines. In general, a plurality of bundles are converged and cross-cut together in newspaper printing to obtain the printed product. The web strands that form a bundle each are converged such that the prints of the web strands of one bundle are centered as accurately as possible between two cuts following each other in the direction of delivery. To obtain their so-called crop mark, i.e., for centering between the cuts, the web strands of one bundle are influenced by means of suitable operations. With respect to the individual web strand, these operations are changes in the path length that the web strand travels between the site of printing and the site of cross cutting, these changes being performed specifically with respect to the crop mark of the web strand in question. The crop mark position of the strand in question or, briefly, the crop mark of the strand is set by specifically changing the path length.

Compensator rollers have proved successful for setting the crop mark. The compensator rollers are wrapped around by a web strand each, usually by 180°. The path of the web strand wrapping around the compensator roller is lengthened or shortened by an adjusting movement of a compensator roller at right angles to its longitudinal axis, and the crop mark of the web strand in question is thus set.

In prior-art printing presses, a printed web strand is guided over an array of turning bars and is turned and/or reversed there. After the turning and/or reversing, the operations suitable for setting the crop mark are performed with the web strand, and the web strand is finally converged with one or more other web strands and cross-cut.

The pulling in of a new web strand is complicated in the prior-art crop mark setting devices. The problem is made more acute by the generally crowded space conditions in the environment of compensator rollers. The compensator rollers must, furthermore, have twice the width of the web strand to be treated, because the web strand may be turned in one print production and reversed in the others.

SUMMARY OF THE INVENTION

The object of the present invention is to design a crop mark setting device and a process for setting the crop mark such that a new web strand can be pulled in mechanically via a compensator roller or another, likewise suitable reversing means of the crop mark setting device.

The present invention pertains to a printing press with at least one printing couple for printing on a web, a lengthwise cutting means, a means for converging web strands, a crosscutting means and a crop mark setting device. At least two prints arranged next to each other are printed continuously on the web in the printing couple. The printed web is cut lengthwise between the prints into a first web strand and at least one other, second web strand by a lengthwise cutting means. The lengthwise cutting means may also be arranged in front of the printing couple and cut the yet unprinted web strand into at least two web strands, which are printed on strand by strand only thereafter. The means for converging web strands comprises a turning bar means for turning and/or reversing the second web strand. The second web strand is preferably converged with the first web strand. In principle, the first web strand and the second web strand may, however, also be converged with one or more other web strands each to form another web strand bundle each. The cross-cutting means is used to cross-cut a web strand bundle comprising at least the second web strand, and preferably also the first web strand. The crop mark setting device comprises a frame, a first deflecting means for deflecting the first web strand around a first deflection axis and an additional, second deflecting means for deflecting the second web strand around a second deflection axis. The second deflecting means is mounted movably in the frame in relation to the first deflecting means such that the length of the path that is traveled by the second web strand is changed relative to the length of the path of the first web strand by a movement of the second deflecting means in relation to the first deflecting means. Even though the deflecting means may, in principle, be formed by rollers or other deflecting bodies, especially rotatably mounted rotary bodies, which are arranged next to each other along the particular deflection axis, each of the deflecting means is, however, formed as a roller in the manner of the prior-art compensator rollers, especially preferably as a regular cylindrical roller.

At least the second deflecting means, i.e., the deflecting means for the second web strand to be led through the turning bar means, is arranged according to the present invention in front of the turning bar means. The second web strand can be pulled in due to this measure mechanically in a simple manner up to the turning bar means.

The arrangement of the first deflecting means in front of the turning bar area is also advantageous, e.g., if the first web strand is to be turned and/or reversed in the turning bar means. However, arranging the two deflecting means at right angles to the web strands next to each other, in which case the deflection axes formed by them preferably extend in the same plane, is always advantageous, even when the first web strand is conveyed farther directly, i.e., without turning and/or reversing, bypassing the turning bar means, and is converged with the second web strand or one or more other web strands printed on in the printing press to form a web strand bundle. The deflecting means for the web strands of the web are arranged in a preferred embodiment of the present invention such that a web that has not yet been cut lengthwise can be pulled at the same time around the deflecting means, as a result of which the mechanical pulling in of the web is considerably facilitated. No other deflecting means, which would be wrapped around by only a single one of the web strands of the web, are arranged between the deflecting means to achieve this. They are preferably even arranged next to one another in the sense that no other deflecting means for the web are arranged between them in the path of the web. Lengthwise cutting is preferably performed during the pulling in of the web only when the web has been pulled in by the crop mark setting device thus formed.

The arrangement of the deflecting means for the single web strand or for the plurality of web strands of the web in front of the turning bar means has the additional advantage, besides the simplification of the mechanical pulling in of the web, that the associated deflecting means may have the width of a single web and it no longer needs to have the double width of the web as before.

In the embodiment in which the deflecting means are arranged next to each other at right angles to the web strands in close proximity in space, they are preferably supported on one side each of the frame only, while they project with a free end each in the direction of the respective other side of the frame. Due to an adjusting movement taking place between the two deflecting means, the two deflecting means can be preferably brought into a position in which they are flush with one another and form a preferably cylindrical, smooth, uniform surface for the web to be pulled in.

It is sufficient in simple embodiments to mount only the second deflecting means movably in the frame to perform adjusting movements. However, the first deflecting means is preferably also mounted movably in the frame. The movable mounting of the first deflecting means as well is advantageous, e.g., when the first web strand is to be turned and/or reversed in one print position or another. However, the movable mounting of the second deflecting means is also advantageous if the first web strand is neither turned nor reversed before the bundle formation, but is converged as a direct strand with the second web strand and/or with one or more other web strands. New possibilities of crop mark setting are opened up precisely for this case, when the extent of the mobility is only great enough. A maximum length of the adjustment path of the first deflecting means should be at least half the maximum length of an adjustment path of the second deflecting means. It is even more preferred if it is at least essentially or exactly as great as the maximum length of the adjustment path of the second deflecting means.

In a preferred process for setting the crop mark, in which the first web strand forms a direct strand of a web strand bundle, the path length of the first web strand is changed as well, namely, in agreement with the additional web strand of the bundle or the plurality of additional web strands of the bundle. If, e.g., only the first web strand and the second web strand form a web strand bundle, the crop mark positions of the two web strands can be set by essentially equal, preferably exactly equal adjustment paths of the first deflecting means and the second deflecting means. It is no longer necessary now to compensate the entire position difference or at least the substantially greater part of the position difference in the second web strand, but only approximately or exactly half the position difference, while the remaining rest is compensated in the direct strand. This also applies in the same manner to the case in which the first web strand and the second web strand are also converged with additional web strands or the first web strand is not converged with the second web strand but only with another web strand or other web strands to form a web strand bundle. The crop marks of the web strands per bundle are set in such a way that the setting time needed for setting all crop marks of these web strands is reduced or preferably even minimal compared with the prior-art setting process. The greatest adjustment path that an individual deflecting means of these deflecting means must perform can be reduced and preferably minimized by coordinated adjusting movements of the deflecting means, which act on the web strands of the bundle and are used to set the crop mark. Since the time needed for setting the crop marks of all web strands of a bundle is proportional to the greatest of the adjustment paths that one or more of the deflecting means must travel or is at least determined by the greatest of the adjustment paths at equal speed of adjustment of the deflecting means, the setting time and, as a result, spoilage are reduced.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
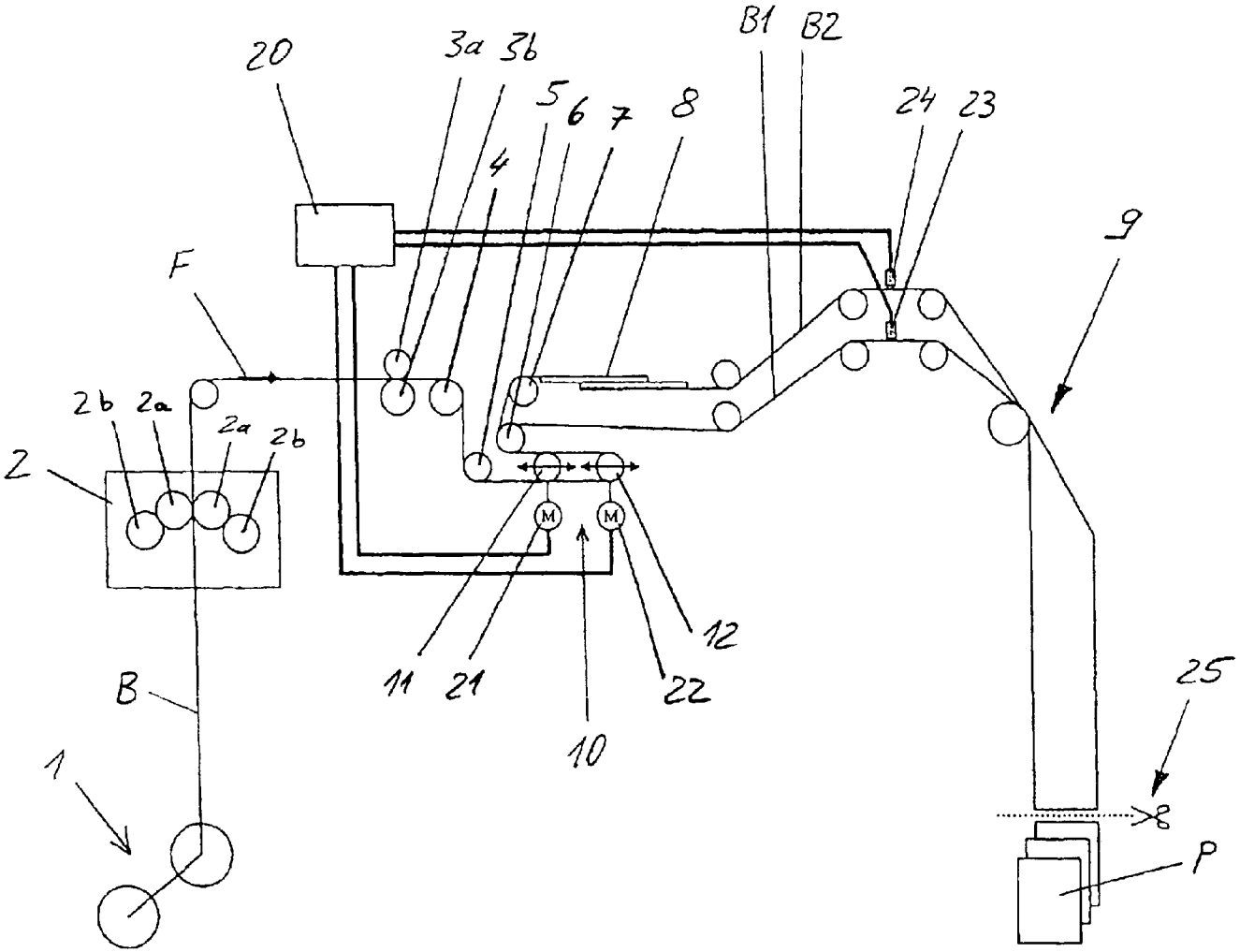
FIG. 1 is a schematic view showing a printing press with a crop mark setting device, which is arranged in front of a turning bar means.

Referring to the drawings in particular, FIG. 1 shows the path of a web B through a web-fed rotary printing press for printing newspapers. The web B is unwound from a roll, which is mounted in a rotatingly driven manner in a roll changer 1, and is delivered in a direction of delivery F through a printing couple 2. It is printed on both sides in the printing couple 2. The printing couple 2 comprises two rubber blanket cylinders 2*a*, between which a printing gap is formed for the web B running through. A printing form cylinder 2*b* each is associated with the rubber blanket cylinders 2*a*. The printing form cylinders 2*b* transfer their prints covered with printing ink in the pattern of an image to the rubber blanket cylinders 2*a*, by which they are finally printed on the web B. The rubber blanket cylinders 2*a* are preferably not coupled mechanically with one another, but are driven by a separate drive motor each in an electronically synchronized manner, and they drive in turn the associated printing form cylinder 2*b* via a mechanical gear mechanism each. The printing form cylinders 2*b* carry on their surface, next to each other in the longitudinal direction of the cylinder, at least two printing forms, whose prints are correspondingly printed next to each other on the web B. A single printing form or, as is usual, two printing forms or, in principle, even more than two printing forms may be provided one after another in the circumferential direction on the printing form cylinders 2*b*. When viewed in the longitudinal direction of the cylinder, the printing forms have the width of an opened newspaper page each.

To form the individual printed copies, newspaper copies in the exemplary embodiment, the web B is cut lengthwise between the prints by means of a lengthwise cutting means after the printing. The lengthwise cutting means is formed by a cutting roller 3*a* and a counterroller 3*b*, which are arranged on one side of the web B each opposite each other.

Two web strands B1 and B2, which will hereinafter be called the first web strand B1 and the second web strand B2, are obtained from the web B by the lengthwise cutting. The web strands B1 and B2 are subsequently delivered together via a draw roller 4 to a crop mark setting device 10. On running out from the crop mark setting device 10, the paths of the web strands B1 and B2 separate. The first web strand B1 is led from the crop mark setting device 10 only via web guiding means without turning or reversing operations to a lengthwise folding means 9, which is preferably designed as a former. The second web strand B2 runs out of the crop mark setting device 10 and into a turning bar means 8. While passing through the turning bar means 8, the second web strand B2 is turned and/or reversed and subsequently converged with the first web strand B1 over an intake roller of the lengthwise folding means 9 to form a web strand bundle, which comprises only the two web strands B1 and B2 in the exemplary embodiment. However, it is also possible for one or more additional web strands of another web or of a plurality of other webs to be united with the two web strands B1 and B2 in front of the lengthwise folding means 9. The web strands B1 and B2 lying one on top of another in the bundle are folded lengthwise together while passing through the lengthwise folding means 9 and are delivered into a crosscutting means 25. The cross-cutting means 25 may be especially a cutting cylinder of a folder, as is usually used in the web-fed rotary printing of newspapers. The lengthwise folded and cross-cut individual copies of printed products are designated by P. If these are newspaper copies, as in the exemplary embodiment, they are also cross-folded after the cross-cutting to finally obtain the newspaper copies. Although even a web strand bundle comprising only the web strands B1 and B2 may already form a printed product P after the cross-cutting, additionally web strand bundles formed in the same manner are usually united with the web strand bundle B1/B2 in newspaper printing, and the plurality of web strand bundles, lying one on top of another, are subsequently cross-cut in the cross-cutting means 25.

It is ensured by means of the crop mark setting device 10 that the prints of the web strands B1 and B2 will always come to lie between consecutive cuts of the cross-cutting means 25 and are properly centered between the cuts in the practical operation, i.e., they are positioned with sufficient accuracy in relation to the common crop mark. The different paths of the web strands B1 and B2 from the printing to the site of convergence in the lengthwise folding means 9 and possibly an offset of the printing forms located next to each other on the printing form cylinders in the circumferential direction, i.e., an offset of the prints of the first web strand B1 in relation to the prints of the second web strand B2 in the direction of conveying F, must be compensated for this positioning. Such an offset is common in newspaper printing to reduce balance errors due to channel beats of the ink-transferring cylinders of the printing couples. Furthermore, the length of the prints measured in the direction of conveying F, which is represented in a printing press control ultimately by the circumference of the printing form cylinders, should be taken into account. If differences in length that are relevant for the crop mark position develop to an extent that is relevant for practice due to the different paths of the web strands B1 and B2 because of differences in the longitudinal elongations, these differences in length, which affect the crop mark, are also compensated by means of the crop mark setting device 10. The different influential factors cause the position of the prints of the web strands B1 and B2 to deviate from the correct crop mark position. These deviations will hereinafter be called position differences for the sake of simplicity.

The crop mark setting device 10 comprises two deflecting means, namely, a first deflecting means 11 and a second deflecting means 12, as well as a deflecting roller 5 at the intake to the deflecting means 11 and 12 and another deflecting roller 6 at the outlet from the deflecting means 11 and 12.

The two web strands B1 and B2 wrap around the intake deflecting roller 5 as well as the outlet deflecting roller 6 together, i.e., in parallel next to each other. The web strands separate at the outlet deflecting roller 6. The first web strand B1 is passed through the area of the turning bar means 8 without turning or reversing operations. The first web strand B1 may therefore also be called a direct strand. The second web strand B2 runs from the outlet deflecting roller 6 via an intake roller 7 into a turning bar plane of the turning bar means 8 and is turned and/or reversed there by a corresponding guiding of the web and is subsequently converged with the first web strand B1. The second web strand B2 may therefore also be called a turned or reversed strand.

While passing through the crop mark setting device 10, the first web strand B1 is guided over the first deflecting means 11 and the second web strand B2 over the second deflecting means 12 and deflected around the deflection axis formed by the respective deflecting means 11 or 12. The intake deflecting roller 5 and the outlet deflecting roller 6 are arranged in relation to the deflecting means 11 and 12 such that the first web strand B1 wraps around the first deflecting means 11 and the second web strand B2 around the second deflecting means 12 by 180° each, so that the web strands B1 and B2 run in parallel onto and off from their deflecting means 11 or 12. The two deflecting rollers 5 and 6 are stationarily but rotatably mounted roller bodies. The deflecting means 11 and 12 are likewise formed by a rotatably mounted roller body each. Both deflecting means 11 and 12 are mounted movably to and fro in a common plane of movement linearly along a common axis of movement at right angles to their axes of rotation, which also form the said deflection axes at the same time. The direction of mobility (axis of movement) is parallel to the web strands B1 and B2, which run from the intake deflection roller 5 to the deflecting means 11 and 12 and from the deflecting means 11 and 12 to the outlet deflection roller 6. The direction of the alternating mobility is indicated by a double arrow each at the deflecting means 11 and 12.

The arrangement of the crop mark setting device 10 in the path of the second web strand B2, i.e., the turned strand, in front of the turning bar means 8 has the advantage that the deflecting means 12 of this strand, which affects the crop mark position, can be made in the width of the second web strand B2 and does not have to have twice the width of the web strand, as in the case of the conventional arrangement after the turning bar means 8. Furthermore, the setting of the crop mark for the second web strand B2 before the turning and/or reversing operation is performed makes possible the mechanical intake of the start of a new web up to behind the crop mark setting device 10 for the second web strand B2.

Figure 2:
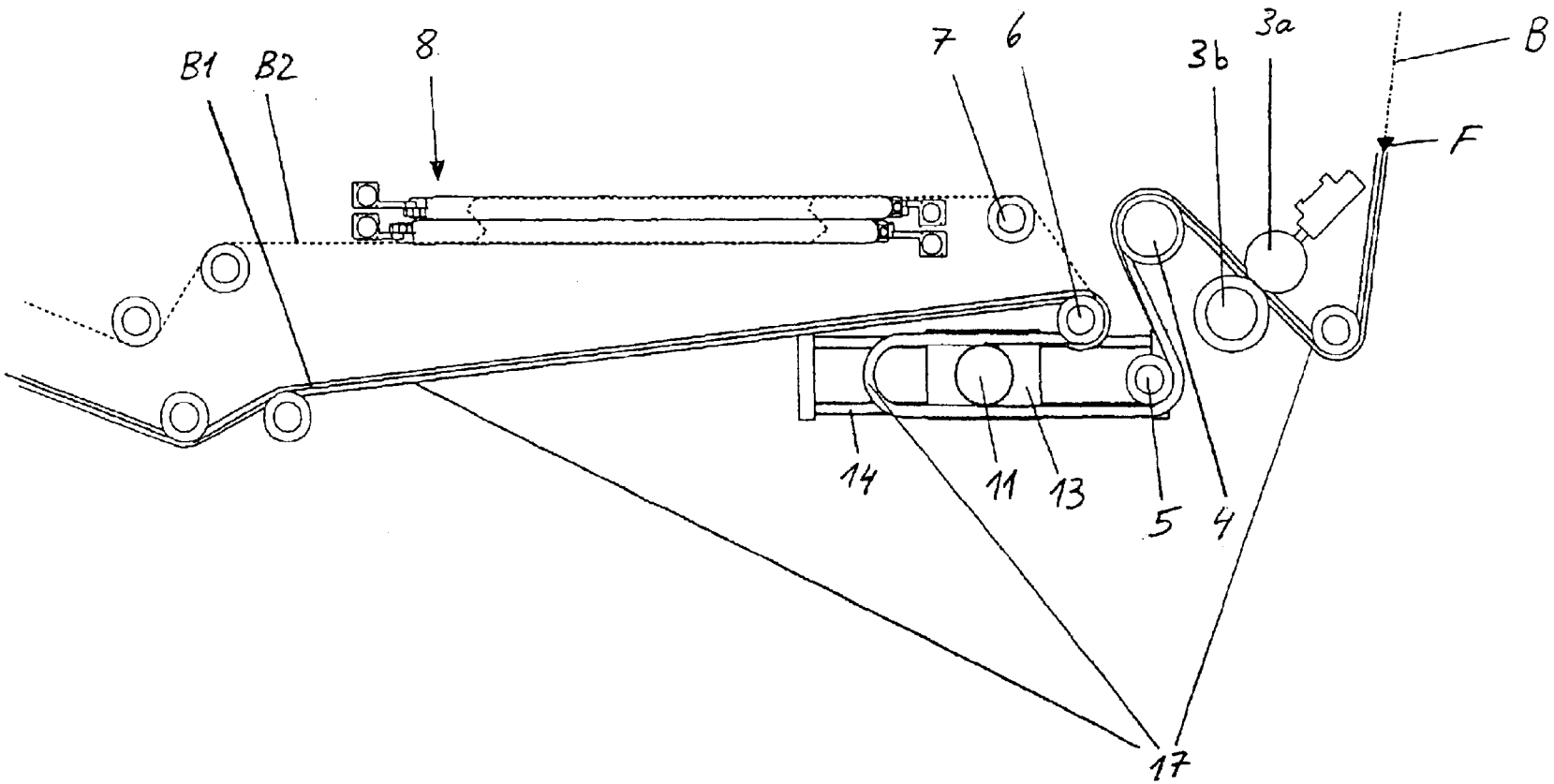
FIG. 2 is a schematic view showing a view of the crop mark setting device in a first state.

FIG. 2 shows a guideway 17 of a mechanical and in this sense automatic web pulling in system. The guideway 17 is formed by guide rails, which are arranged on one side next to the web guide means and are used to guide a driven intake means. In particular, the guideway 17 runs around the deflecting means 11 and 12 of the crop mark setting device 10. The guideway 17 is run, furthermore, around the intake deflecting roller 5 and the outlet deflecting roller 6 and farther along the path of the first web strand B1. When a new web B is being pulled in, which is indicated in FIG. 2, the start of this web is led through between the cutting roller 3*a* and the counterroller 3*b* along the guideway 17, around the draw roller 4, the intake deflecting roller 5, to and around the two deflecting means 11 and 12, and then back again from there and is pulled around the outlet deflecting roller 6 and farther along the path of the first web strand B1.

Figure 3:
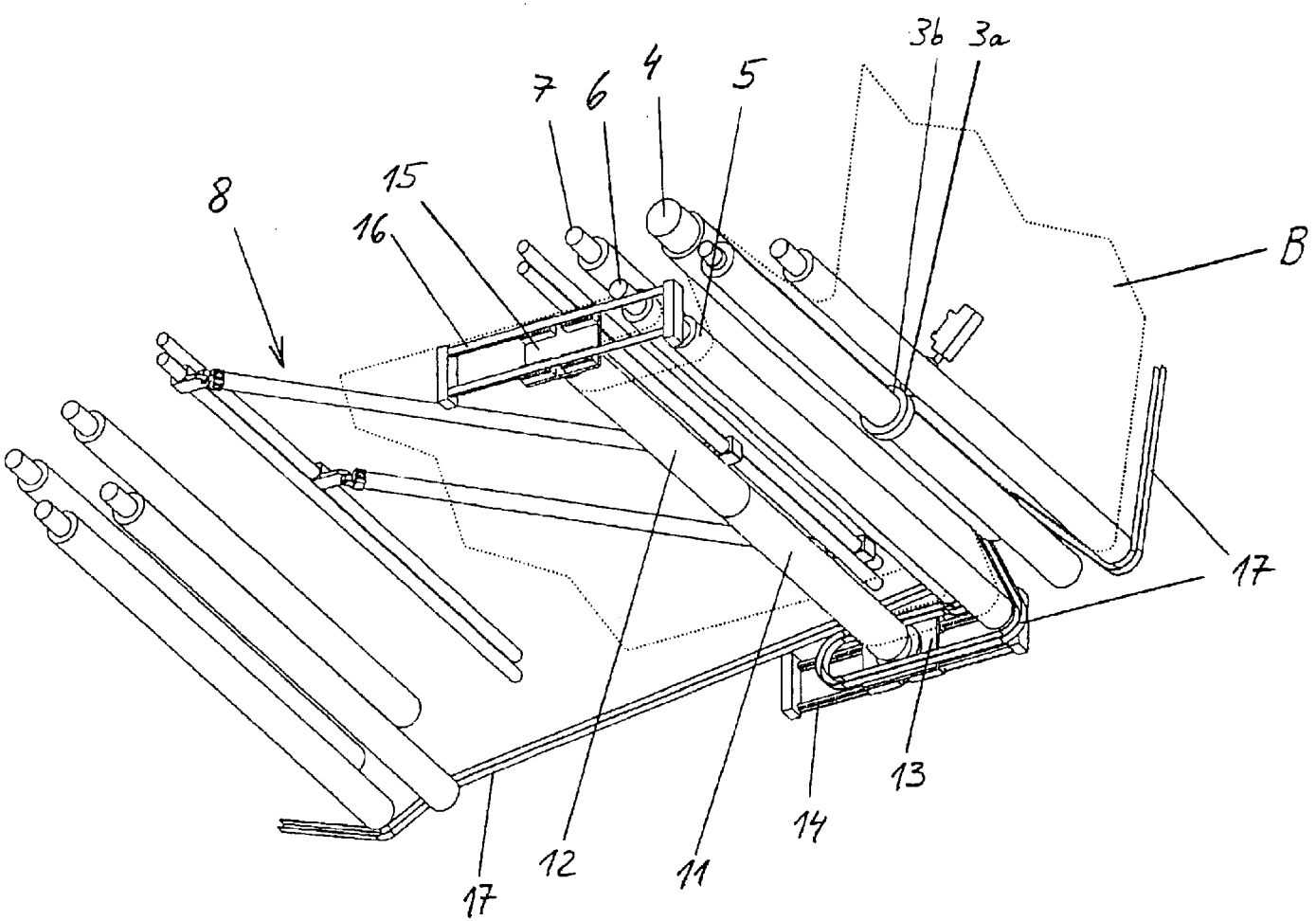
FIG. 3 is a perspective view of the crop mark setting device in a first state.

FIG. 3 shows the web B in this state immediately after the mechanical pulling in over the complete path of the later first web strand B1. The rollers 3*a* and 3*b* of the lengthwise cutting means are moved toward each other in this state and the web B is cut lengthwise between the later prints. After a web start was formed for the second web strand B2, e.g., by tearing off manually after the lengthwise cutting, the start of the second web strand B2 is pulled in manually from the outlet deflecting roller 6 over the intake roller 7 for the turning bar means 8, through the turning bar means 8 and over the downstream web guide means. The manual pulling in via a deflecting means of a crop mark setting device is eliminated, which offers advantages in terms of time and contributes to a reduction of pulling-in errors.

Figure 4:
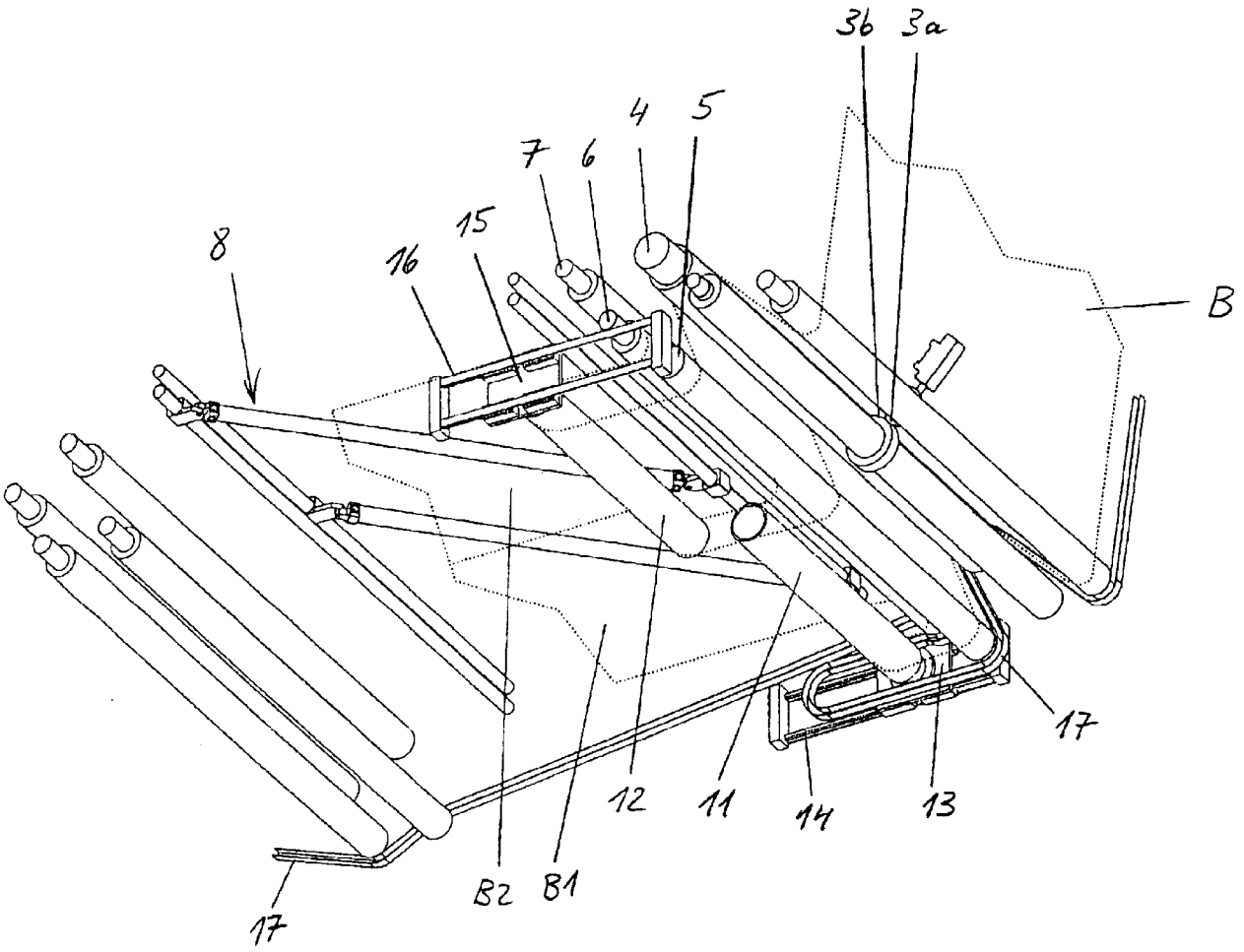
FIG. 4 is a perspective view of the crop mark setting device in a second state.

FIG. 4 shows the web B after the lengthwise cutting and before the formation of a start for the second web strand B2.

FIG. 1 also shows a control and regulating means, which is used to control and regulate the adjusting movements of the two deflecting means 11 and 12. The control and regulating means comprises two sensors 23 and 24, a control and regulating member 20 and two motor-driven final control elements 21 and 22. The sensor 23 detects the position of the print on the first web strand B1 running through under it, and the sensor 24 detects the position of the prints on the second web strand B2 running through under it. The position signals of the sensors 23 and 24 are sent to the control and regulating member 20. The control and regulating member 20 calculates the two sensor signals by means of a suitable algorithm and forms from them the setting signals for the final control elements 21 and 22 by comparison with desired input signals. The final control element 21 is coupled with the first deflecting means 11 and the final control element 22 with the second deflecting means 12. The final control elements 21 and 22 act on the deflecting means 11 and 12 corresponding to the setting signals formed by the control and regulating member 22, i.e., they bring about the adjusting movement of the deflecting means 11 and 12 along their common axis of movement of these deflecting means. During the running printing operation, the control and regulating member 20 forms a regulating unit with the sensors 23 and 24 and with the final control elements 21 and 22 for setting the correct crop mark position for each of the web strands B1 and B2. These members form a control and regulating unit until a basic setting is obtained especially when a new print production is started.

FIGS. 3 and 4 show the crop mark setting device 10 and its immediate environment in the same view in a three-dimensional view, but in two different states of the crop mark setting device 10. The states differ by the positions assumed by the deflecting means 11 and 12 in relation to one another. The design of the two deflecting means 11 and 12 as regular cylindrical, smooth roller bodies each, having the width of the strand, can be recognized, in particular. Due to the design as roller bodies having the width of the strand, the deflecting means 11 and 12 can be arranged in a narrow space next to one another. The deflecting means 11 and 12 are arranged and mounted movably such that they have the same height in relation to the direction of conveying F of the web B, as is shown in FIG. 3, and they even form a smooth, uniform roller body in an axially continuous manner, which is especially preferred. The roller body formed by the two deflecting means 11 and 12 together forms a simple deflecting roller during the pulling in of a new web. The inevitable gap between the free ends of the roller bodies is kept so narrow within the tolerances that it can be ignored for the pulling in of the web B. The roller body is uniform in this sense. The deflection axes formed by the deflecting means 11 and 12 are aligned in the first state. In the first state, the deflecting means 11 and 12 assume their respective initial basic positions in relation to one another, in which a web with free start is pulled in.

The deflecting means 11 and 12 can be moved away from each other in opposite directions from the first state by means of the final control elements 21 and 22, e.g., into the second state shown in FIG. 4, in which their deflection axes are offset at a maximum distance in parallel to one another. In the second state shown, the deflecting means 11 and 12 assume positions in which the path of the first web strand B1 has a minimum length and the path of the second web strand B2 has a maximum web length. The deflecting means 11 and 12 can also be moved from the position that they assume in the first state into their two other extreme positions if this is required by the crop mark regulation. Intermediate states can, of course, be set as well, preferably continuously.

To obtain the adjusting movements, the deflecting means 11 and 12 are mounted in a linearly guided manner at their outer axial ends facing away from each other on one side each of a frame along the axis of movement. The side of the frame on which the first deflecting means 11 is mounted is designated by 14, and the side of the frame on which the second deflecting means 12 is mounted is designated by 16. The frame sides 14 and 16 form a guideway each, which is parallel to the axis of movement. The deflecting means 11 and 12 are mounted rotatably on one of two carriages 13 and 15, which is guided linearly by the guideway formed by its frame side 14 or 16. The two carriages 13 and 15 ensure the rigid mounting of the deflecting means 11 and 12 on their respective frame side 14 or 16. The deflection axes formed by the deflecting means 11 and 12 form a right angle each with the guideways formed by the frame sides 14 and 16.

The adjustability of the deflecting means 11 and 12 is such due to their mounting and the coupling with the final control elements 21 and 22 that the adjusting movements necessary for positioning the crop marks of the two web strands B1 and B2 can be split between the deflecting means 11 and 12, preferably at least essentially in half, and especially preferably exactly in half The maximum lengths of the adjusting paths of the deflecting means 11 and 12 are correspondingly equal. Due to the deflecting means 11 and 12 being advantageously arranged directly next to each other, the adjusting paths are, in fact, equal, i.e., the deflection axis formed by the first deflecting means 11 and the deflection axis formed by the second deflecting means 12 can be moved to and fro between the two equal outer extreme positions. The two deflecting means 11 and 12 are therefore equivalent in the ideal case described.

The adjustability of the first deflecting means 11 opens up new possibilities for setting the crop marks of the direct strand and of the turned strand, i.e., for controlling and/or regulating the web strands B1 and B2.

When setting the crop marks, the differences in the positions of the respective prints, which difference exists between the direct strand and the turned strand, is conventionally compensated solely by changing the length of the web strand of the turned strand. By contrast, the positioning of the print in good register on the direct strand is ensured by the printing couple. An adjustment of the path length of the direct strand is performed at best to a limited extent, and this adjustment is not performed in reference to the crop mark of the other web strand or the crop marks of the plurality of other web strands of the bundle, but only in reference to the position of the cut in the cross-cutting means. The path length of a strand is defined in the sense of the present invention as the path length of the strand in question beginning from its formation, i.e., the site of lengthwise cutting in the strands B1 and B2, to the convergence. In the prior-art setting processes, the direct strand is the leading strand of the bundle, to which the other web strands of the bundle are adjusted. In the case of the other web strand or the plurality of other web strands of the bundle, this manner of crop mark setting requires long adjusting paths for their deflecting means, which are used for the setting. The adjusting paths are typically on the order of magnitude of 200 mm to 400 mm. On the other hand, the speed of the adjusting movement is limited. Thus, experience has shown that a linear register, and each of the deflecting means 11 and 12 is such a linear register, may lengthen the path of the strand by a maximum of 1 mm per meter of web. If, e.g., an adjusting path, i.e., register path of 300 mm is required to change the print production over to another print production with the print production running without interruption, at least 300 m of web run through the printing press before the crop mark is readjusted. If the printed products are newspaper copies, whose length shall be assumed to be 1 m to simplify the estimate, the new crop mark will have been set only after 300 printed copies. The first 300 printed copies of the new production are spoilage.

However, the adjusting movement necessary for setting the crop mark can be now split between two web strands B1 and B2 due to the special adjustability of the deflecting means 11 for the direct, first web strand B1. More generally, the adjusting path for the turned strand of the web strand bundle is reduced by part of it, preferably half of the adjusting path for the turned strand, being taken over by the crop mark setting member for the direct strand, the first deflecting means 11 in the exemplary embodiment. The total adjusting path necessary is preferably split uniformly. If the direct strand is converged with a plurality of web strands to form a bundle, the adjusting paths are preferably split as uniformly as possible among the web strands to be converged. The adjustment is advantageously performed under the optimization strategy that the setting time becomes minimal under the assumption of equal adjustment speeds for the setting of the crop marks.

Precisely this concept of setting is embodied by means of the crop mark setting device 10 according to the present invention. Instead of carrying out the entire position difference of the crop mark of the second web strand B2 by the adjusting movement of the second deflecting means 12, part, preferably half, of the adjusting movement to transferred to the first deflecting means 11. If the deflecting means 12 of the second web strand B2 had to be adjusted by 300 mm along its axis of movement in case of the exclusive setting of the crop mark of the second web strand B2 in order to compensate a position difference of 600 mm between the web strands B1 and B2, an adjusting path of only 150 mm is needed in case of the 50:50 split for the deflecting means 11 and 12 from their respective starting positions which they assumed before the adjustment. The path of the first web strand B1 is lengthened by the same amount as the path of the second web strand B2 is shortened. Depending on the starting positions from which the deflecting means 11 and 12 are adjusted and the path length changes that shall be made, setting in the reverse direction, i.e., shortening the path of the first web strand B1 and lengthening the path of the second web strand B2, may sometimes also be advantageous. The reduction of the length of the adjusting path of the second deflecting means 12 is also especially advantageous at the time of a changeover from one printed product to another with the print production running, because spoilage can be considerably reduced.

However, the new crop mark setting may have the consequence that the first web strand B1 is not in register with the cut because of the change in its path length, even though the color mark or the color marks were in register with the cut before the adjustment. The direct, first web strand B1 is brought into register with the cut in another way, e.g., by means of a compensator roller for web B or preferably by a coordinated adjustment of the circumferential registers of the cylinders that transfer the ink onto the web B. The cross-cutting means may also be adjusted in agreement with the path length changes of the web strands B1 and B2. Both the circumferential registers of the ink-transferring cylinders and the cross-cutting means may be adjusted in a coordinated manner if necessary. This part of the registering is performed jointly with all web strands B1 and B2 of the same web B and with all web strands of the bundle. Registering web by web and strand by strand are correspondingly coordinated with each other for the cut per bundle and preferably performed simultaneously. What was said on the basis of the exemplary embodiment regarding the registering by means of these additional crop mark setting members also applies to the general case of the present invention, in which the web strand bundle being considered also contains one or several additional web strands besides the web strands B1 and B2 or only one of the web strands B1 and B2.

The present invention is already advantageous even for a printing press for one-sided, single-color printing or for two-sided printing in a single printing gap of a printing couple, as is described for the purpose of explaining a printing couple on the basis of FIG. 1. The printing press may have a plurality of printing couples of this type, i.e., rubber-on-rubber printing couples, and/or even of another type, e.g., satellite printing couples, and the different types of printing couples are arranged and operated such that the web B is printed on in multiple colors or a plurality of webs B are printed on in a single color or in multiple colors. Each of the cylinders touching the web and printing ink on the web is preferably driven by a separate motor each, and the necessary synchronization of the cylinders in question is performed by means of signals, e.g., electronically, rather than mechanically. This manner of forming the print positions is advantageous in respect to the adjustment of the color mark, with which the change in the position of the direct strand B1 in relation to the cut is preferably compensated. One crop mark setting device 10 according to the present invention is preferably arranged for each of the webs of a plurality of webs and it preferably also has the additional features of this setting device.

If, e.g., the web strands B1 and B2 are converged with a third web strand B3 to form a bundle, and if the position difference of the second web strand B2 from the cut were, e.g., 300 mm and the position difference of the third web strand B3 from the cut were, e.g., 400 mm, while the first web strand B1 assumes, e.g., a correct crop mark position at the time of the measurement, i.e., the position difference is "zero," the change in the path length of the strand that would be necessary in the case of the conventional setting process would be 300 mm for the second web strand B2 and 400 mm for the third web strand B3, whereas no compensation would be necessary for the first web strand B1, and the adjusting path of the first deflecting means 11 would therefore be "zero." The greatest change in the path length of the strand and the greatest adjusting path length of the deflecting means in question would be necessary for the third web strand B3. The deflecting means of this web strand would have to be moved by the greatest adjusting path length from its initial position. The total setting time necessary would correspond to the time that would be needed to move the deflecting means for the third web strand B3 from the initial position it assumed before the setting by the adjusting path length necessary for changing the path length of the web by 400 mm.

Assuming that the paths of both web strands B2 and B3 would have to be shortened in this example, the path length of the first web strand B1 is lengthened by 200 mm in the most optimal embodiment variant of the setting process according to the present invention, in which the greatest of the adjusting path lengths is minimized. The path of the second web strand B2 correspondingly needs to be shortened by only 100 mm rather than by 300 mm. However, the greatest of the web path length changes, namely, that for the third web strand B3, is markedly reduced, in particular. The shortening of the path length that is still necessary for the third web strand B3 is no longer 400 mm but only 200 mm. This corresponds in the example to the minimum of the path length change for the third web strand B3. In the embodiment of the deflecting means described on the basis of the exemplary embodiment, the greatest of the adjusting path lengths by which one of the deflecting means must be adjusted is 100 mm. The first deflecting means 11 must be adjusted in the example by 100 mm for lengthening the path of the strand in question, and the deflecting means for the third web strand B3 must be adjusted likewise by 100 mm for shortening the path of the strand in question by an equal amount.

The greatest of the web path length changes and the greatest of the adjusting path lengths were minimized in the above example. However, the present invention is not limited to such an absolute minimization, but it also covers suboptimal embodiment variants of the setting process. In reference to the example, lengthening the path of the first web strand B1 by only, e.g., 150 mm and correspondingly shortening the path of the second web strand B2 by 150 mm and the path of the third web strand B3 by 250 mm to bring all three web strands B1, B2 and B3 to the said crop mark position would thus still be covered by the present invention as well.

The third web strand B3 in the example explained above may be a web strand that is obtained by lengthwise cutting from the same web B as the first web strand B1 and the second web strand B2. However, the third web strand B3 does not have to have been obtained from the same web B as the other two web strands B1 and B2, but it may also have been obtained from another web by lengthwise cutting. It may, in principle, even have been unwound from a roll directly in the width of a web strand. Finally, the web strands B1 and B2 obtained from the same web B do not have to be converged, either, but each of the web strands B1 and B2 may also be converged only with one web strand or with a plurality of web strands of other printed webs to form a web strand bundle each. The setting process according to the present invention and the arrangement according to the present invention of individual or all crop mark setting members for the web strands before the turning bars and also the arrangement of the crop mark setting members provided for each web for their strands in mutually closely spaced locations in space are advantageous in many different web guiding patterns which lead to the formation of web strand bundles.

While a specific embodiment of the invention has been shown and described in detail to illustrate the application of the principles of the invention, it will be understood that the invention may be embodied otherwise without departing from such principles.

What is claimed is:

1. A printing press with crop mark setting device, the printing press with crop mark setting device comprising:

a printing couple for printing on a web;

a lengthwise cutting means for cutting the printed web lengthwise into a first web strand and at least one second web strand;

a convergence means for converging said web strands or for converging said web strands with at least one other web strand each to provide one or more converged web strands, the convergence means comprising a turning bar means;

a cross-cutting means for cross-cutting said converged web strands; and a crop mark setting device for setting a crop mark of said web strands that is related to the cross cutting, said crop mark setting device comprising, a first deflecting means for deflecting said first web strand around a first deflection axis and a second deflecting means for deflecting said second web strand around a second deflection axis, said second deflecting means being mounted movably in relation to said first deflecting means in a frame such that a length of a path of said second web strand in relation to the length of the path of said first web strand can be changed by a movement of said second deflecting means in relation to said first deflecting means, said crop mark setting device being arranged in front of said turning bar means with respect to a direction of delivery of said web.

2. A printing press with crop mark setting device in accordance with claim 1, wherein said first deflecting means and said second deflecting means are arranged next to each other in said frame at right angles to said second web strand.

3. A printing press with crop mark setting device in accordance with claim 1, wherein said second deflecting means is mounted movably, preferably guided along a straight line, at right angles to the deflection axis formed by it.

4. A printing press with crop mark setting device in accordance claim 1, wherein said first deflecting means is mounted movably guided along a straight line, in relation to said frame and said second deflecting means is mounted movably, preferably guided along a straight line, in relation to said deflection axis formed by it, in order to also make it possible to change the length of the path of the first web strand.

5. A printing press with crop mark setting device in accordance with claim 1, wherein said first deflecting means is movable by a first maximum adjusting path length and said second deflecting means is movable by a second maximum adjusting path length, and said first maximum adjusting path length is at least half to as great as a second maximum adjusting path length.

6. A printing press with crop mark setting device in accordance with claim 1, further comprising: a control and/or regulating means with a setting means for moving said deflecting means such that for one of said web strands a path length is increased and the length of the path is reduced for the other of said web strands.

7. A printing press with crop mark setting device in accordance with claim 1, further comprising: a control and/or regulating means with a setting means for moving said deflecting means such that the path lengths of said web strands can be changed simultaneously.

8. A printing press with crop mark setting device in accordance with claim 1, wherein said second deflecting means and/or said first deflecting means can be moved into a position in which said second deflecting means and/or said first deflecting means can be wrapped around together by said web.

9. A printing press with crop mark setting device in accordance with claim 1, wherein said first deflecting means is a first roller body and said second deflecting means is a second roller body, and said roller bodies together form a deflecting roller in a first position and a separate deflecting roller in a second position.

10. A printing press with crop mark setting device in accordance with claim 1, wherein:

said frame has a first frame side and a second frame side located opposite and at spaced locations at right angles to said web;

said first deflecting means is mounted at said first frame side and has a free end facing said second frame side; and said second deflecting means is mounted at said second frame side and has a free end facing said first frame side.

11. A printing press with crop mark setting device in accordance with claim 1, wherein a width of said first deflecting means measured in the direction of said first deflection axis substantially corresponds to a width of the first web strand.

12. A printing press with crop mark setting device in accordance with claim 1, wherein a width of said second deflecting means measured in the direction of said second deflection axis substantially corresponds to a width of the second web strand.

13. A printing press with crop mark setting device in accordance with claim 1, further comprising: an outlet deflecting means located next to said first deflecting means and said second deflecting means in the paths of said web strands associated with said first deflecting means and with said second deflecting means together by being able to be wrapped around by said first web strand and by said second web strand together.

14. A printing press with crop mark setting device in accordance with claim 1, further comprising an intake deflecting means arranged upstream closest to said first deflecting means and said second deflecting means in a path of said web or in the paths of said web strands, said an intake deflecting means being associated together with said first deflecting means and with said second deflecting means by being able to be wrapped around by said web or by said first web strand and by said second web strand together.

15. A process for setting the crop mark for and/or in a print production, the process comprising:

printing at least two prints continuously on a web, the prints being arranged next to each other at right angles to a direction of delivery of the web;

cutting the web lengthwise between said printed-on or yet-to-be-printed prints into a first web strand and a second web strand;

turning or reversing at least one of the web strands;

converging the web strands after the turning and/or reversing of the second web strand or converging each web strand with another printed-on web strand;

cross-cutting said converged web strands between said prints following each other in said direction of delivery in order to obtain individual printed products;

setting a crop mark position of at least said second web strand using a crop mark setting device, said crop mark position being related to said cross cutting, the crop mark setting device including a first deflector wrapped around by said first web strand and a second deflector wrapped around by said second web strand before the turning and/or reversing of the second web strand by a movement of said second deflector changing a length of the path of said second web strand.

16. A process in accordance with claim 15, wherein a crop mark position of said second web strand is related to the cross cutting and is also set in said crop mark setting device by a movement of said first deflector to change the length of the path of said first web strand.

17. A process in accordance with claim 15, wherein said first web strand is converged with said second web strand or with at least one other web strand directly without turning and is cross-cut.

18. A process in accordance with claim 15, wherein said first web strand and said second web strand are converged alone or with at least one other web strand to form a bundle, and said crop mark positions of said web strands of the bundle are set by a movement of both the first deflector and the second deflector by an adjusting path length each in a mutually coordinated manner.

19. A process in accordance with claim 18, wherein crop mark positions of the web strands of the bundle are set simultaneously in order to minimize the setting time needed for setting the crop marks of said web strands.

20. A process in accordance with claim 15, wherein the crop mark positions of the web strands of the bundle are set in such a way that a greatest of the adjusting path lengths is minimized.

21. A process in accordance with claim 15, wherein:

said first web strand is converged with at least two other web strands, one of which is the second web strand, to form a web strand bundle, and the bundle is cross-cut;

each of the web strands of the bundle is conveyed via at least one deflector each, which is adjustable by a adjusting path length to make it possible to adjust the crop mark of the web strand deflected by it; and the crop marks of the web strands of the bundle are set in a coordinated manner such that the adjusting path lengths of said deflector, which are necessary for this, are distributed between the web strands.

* * * * *